US010833392B1

(12) United States Patent
Zekios et al.

(10) Patent No.: US 10,833,392 B1
(45) Date of Patent: Nov. 10, 2020

(54) RECONFIGURABLE FOLDABLE AND/OR ORIGAMI PASSIVE ARRAYS

(71) Applicants: Constantinos L. Zekios, Miami, FL (US); Stavros Georgakopoulos, Miami, FL (US); Akash Biswas, Miami, FL (US)

(72) Inventors: Constantinos L. Zekios, Miami, FL (US); Stavros Georgakopoulos, Miami, FL (US); Akash Biswas, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/546,830

(22) Filed: Aug. 21, 2019

(51) Int. Cl.

| | |
|---|---|
| ***H01Q 1/12*** | (2006.01) |
| ***H01Q 21/00*** | (2006.01) |
| ***H01Q 5/30*** | (2015.01) |
| ***H01Q 21/06*** | (2006.01) |

(52) U.S. Cl.
CPC ..... *H01Q 1/1235* (2013.01); *H01Q 5/30* (2015.01); *H01Q 21/0087* (2013.01); *H01Q 21/061* (2013.01)

(58) Field of Classification Search
None
See application file for complete search history.

(56) References Cited

U.S. PATENT DOCUMENTS

| | | | | |
|---|---|---|---|---|
| 9,214,722 | B2 * | 12/2015 | Georgakopoulos | H01Q 1/36 |
| 10,020,586 | B1 * | 7/2018 | Georgakopoulos | H01Q 1/38 |
| 10,347,962 | B1 * | 7/2019 | Georgakopoulos | H01Q 15/161 |
| 2006/0187124 | A1 * | 8/2006 | Goldberg | H01Q 1/38 343/700 MS |
| 2016/0315352 | A1 * | 10/2016 | Jiang | H01M 10/052 |
| 2017/0021947 | A1 * | 1/2017 | Pellegrino | H02J 3/383 |
| 2017/0338453 | A1 * | 11/2017 | Yu | H01L 23/3121 |
| 2018/0072014 | A1 * | 3/2018 | Dudte | B31D 5/04 |
| 2018/0278200 | A1 * | 9/2018 | Jeon | F16M 11/2085 |
| 2019/0044475 | A1 * | 2/2019 | Jeon | F16M 11/2085 |

* cited by examiner

*Primary Examiner* — Trinh V Dinh
(74) *Attorney, Agent, or Firm* — Saliwanchik, Lloyd & Eisenschenk

(57) ABSTRACT

Passive antenna arrays and methods of using and fabricating the same are provided. A passive antenna array can include a substrate that is capable of being folded and a plurality of antenna elements disposed on the substrate. The substrate can have predefined folding lines such that the substrate can be folded into different positions. The antenna elements can be separated from each other by the folding lines in the substrate. The passive antenna array can exhibit dual band operation and can change its frequency by changing its shape.

16 Claims, 18 Drawing Sheets

RECONFIGURABLE FOLDABLE AND/OR ORIGAMI PASSIVE ARRAYS

GOVERNMENT SUPPORT

This invention was made with government support under Award Number FA9550-18-1-0191 awarded by the Air Force. The government has certain rights in the invention.

BACKGROUND

A passive antenna array is an antenna in which the beam of radio waves can be electronically steered to point in different directions and all the antenna elements are connected to a single transmitter (e.g., a magnetron, a klystron, or a travelling wave tube) and/or receiver. This contrasts with an active array antenna, which has a separate transmitter and/or receiver unit for each antenna element, typically all controlled by a computer. Passive arrays are often used in radars.

BRIEF SUMMARY

Embodiments of the subject invention provide novel and advantageous passive antenna arrays and devices, and methods of using and fabricating the same. A passive antenna array can include a foldable substrate (e.g., an origami substrate that is capable of being folded) and a plurality of antenna elements disposed on the substrate. The substrate can have predefined folding lines (e.g., folding lines for mountain- and/or valley-style folds) such that the substrate can be folded into different positions, which can be referred to as different states of the antenna array. The substrate can be a dielectric substrate. The antenna elements can be separated from each other (e.g., separated into different antenna portions) by the folding lines in the substrate. That is, the folding lines can define antenna portions, each having one or more antenna portions; for example, each antenna portion can have exactly one antenna element. Each antenna element can be any shape (e.g., a tilted Jerusalem-cross shape or a geometric shape such as a square, rhombus, or trapezoid). The passive antenna array can support dual band operation (e.g., can operate as a dual band filter), as opposed to single band operation as with related art passive arrays. The passive antenna array can reconfigure its frequency by changing its shape by folding into a different state. Different folding patterns (e.g., origami folding patterns) can help achieve multi-band operation. The substrate can be a dielectric substrate. Also, instead of a single substrate with folding lines, a plurality of substrates can be used for the antenna portions, respectively, and connected to each other (e.g., via hinges).

In an embodiment, a passive antenna array can comprise: a foldable substrate configured to be folded; and a plurality of antenna elements disposed on the substrate. The foldable substrate can have predefined folding lines, hinges, or both, for folding into a predetermined configuration, such that the passive antenna array has an unfolded state and a plurality of folded states. The predefined folding lines, hinges, or both can divide the substrate into a plurality of antenna portions, and the plurality of antenna elements can be disposed on the plurality of antenna portions, respectively.

In another embodiment, a method of fabricating a passive antenna array can comprise: a) providing a foldable substrate configured to be folded; b) forming a plurality of antenna elements on the foldable substrate; and c) folding the foldable substrate to create folding lines such that the foldable substrate with folding lines is an origami substrate that is configured to be folded into a predetermined configuration, such that the passive antenna array has an unfolded state and a plurality of folded states. Steps b) and c) can be performed in either order. The folding lines can divide the substrate into a plurality of antenna portions, and the plurality of antenna elements can be disposed on the plurality of antenna portions, respectively.

DETAILED DESCRIPTION

Embodiments of the subject invention provide novel and advantageous passive antenna arrays and devices, and methods of using and fabricating the same. A passive antenna array can include a foldable substrate (e.g., an origami substrate that is capable of being folded) and a plurality of antenna elements disposed on the substrate. The substrate can have predefined folding lines (e.g., folding lines for mountain- and/or valley-style folds) such that the substrate can be folded into different positions, which can be referred to as different states of the antenna array. The substrate can be a dielectric substrate. The antenna elements can be separated from each other (e.g., separated into different antenna portions) by the folding lines in the substrate. That is, the folding lines can define antenna portions, each having one or more antenna portions; for example, each antenna portion can have exactly one antenna element. Each antenna element can be any shape (e.g., a tilted Jerusalem-cross shape or a geometric shape such as a square, rhombus, or trapezoid). The passive antenna array can support dual band operation (e.g., can operate as a dual band filter), as opposed to single band operation as with related art passive arrays. The passive antenna array can reconfigure its frequency by changing its shape by folding into a different state. Different folding patterns (e.g., origami folding patterns) can help achieve multi-band operation. The substrate can be a dielectric substrate. Also, instead of a single substrate with folding lines, a plurality of substrates can be used for the antenna portions, respectively, and connected to each other (e.g., via hinges).

Figure 1:
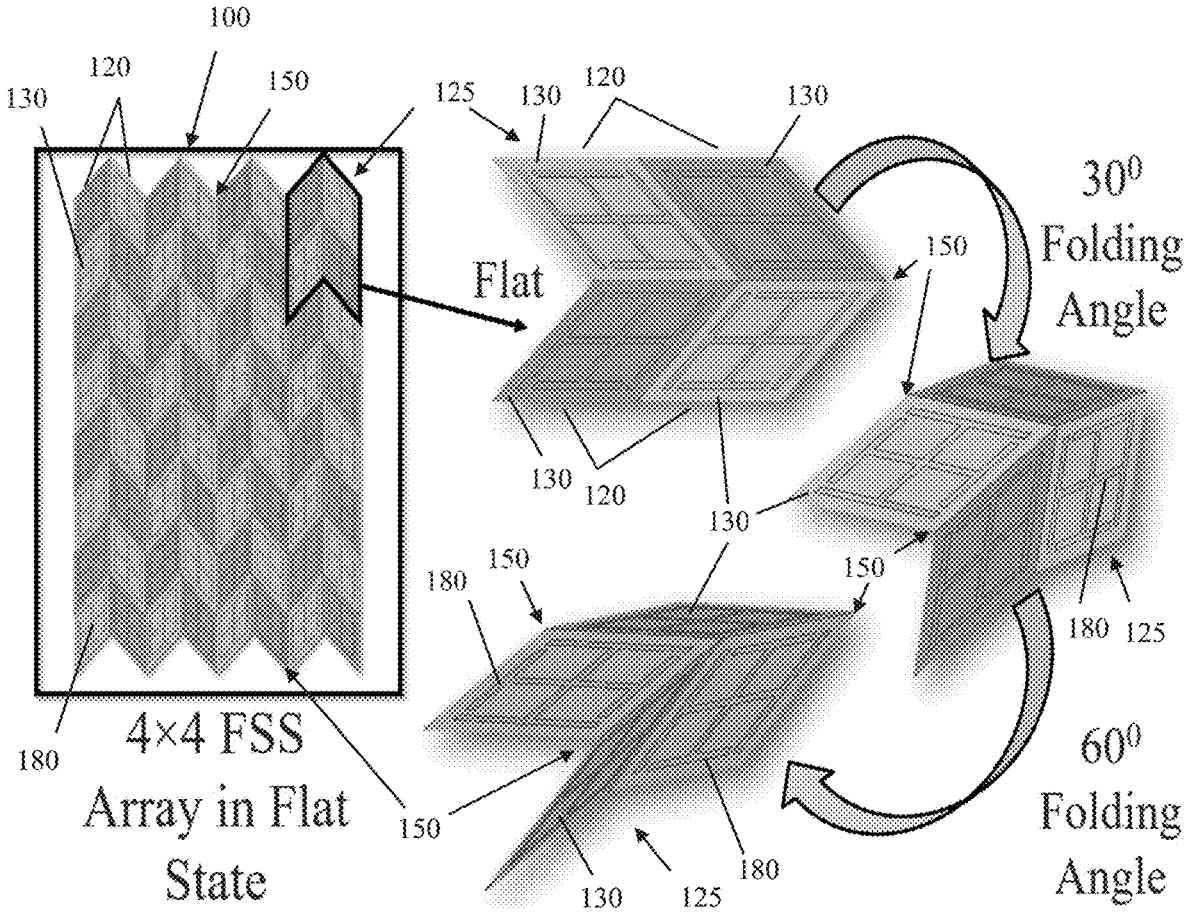
FIG. 1 is a schematic view showing a passive antenna array according to an embodiment of the subject invention. The cutaways show a unit antenna cell of four antenna portions in a flat state (folding angle, ω, =0°), a first folded state (ω=30°), and a second folded state (ω=60°).

FIG. 1 is a schematic view showing a passive antenna array according to an embodiment of the subject invention. Referring to FIG. 1, the passive antenna array 100 can include a substrate 130 and a plurality of antenna elements 180 disposed on the substrate. The substrate can include folding lines 150 (e.g., folding lines for mountain- and/or valley-style folds) for folding the passive antenna array into different (predetermined) folding states. The folding lines 150 can divide the substrate 130 into a plurality of antenna portions 120, and each antenna portion 120 can include an antenna element 180. Though FIG. 1 depicts antenna elements 180 in a tilted Jerusalem-cross shape, embodiments are not limited thereto. Each antenna element can have any suitable shape. Also, the antenna elements 180 of the array 100 can all be the same shape or there can be different shapes present. The array 100 can include a plurality of unit antenna cells 125, each of which includes one or more antenna portions 120. The shape of a unit antenna cell 125 is determined by the predetermined folding states, which can be determined by the folding lines 150. For example, FIG. 1 shows a Miura origami fold pattern, and the unit antenna cell 125 includes four antenna portions 120 as shown in the three cutaway portions of FIG. 1. The Miura origami fold shown in FIG. 1 is for exemplary purposes only and should not be construed as limiting; any suitable fold pattern can be used.

Figure 3:
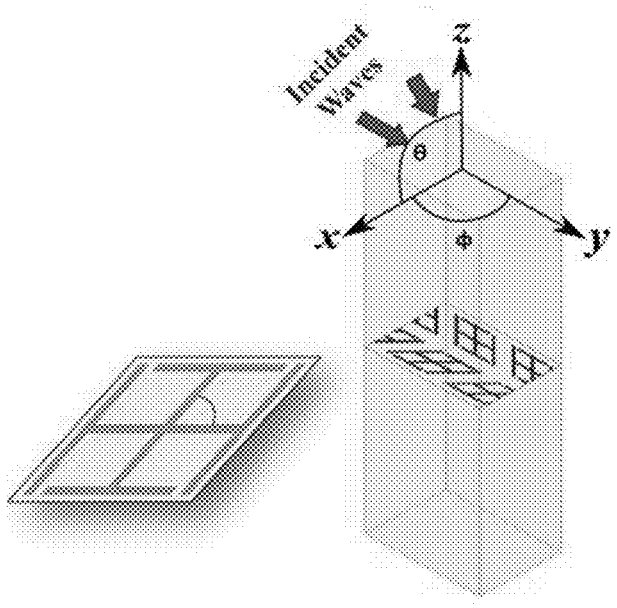
FIG. 3 is a schematic view showing a portion of a passive antenna array according to an embodiment of the subject invention.

Referring still to FIG. 1, the top-left cutaway portion (upper-middle of the overall figure) shows a flat (unfolded) unit antenna cell 125 (folding angle (ω)=0°); the right-most cutaway portion shows the unit antenna cell 125 with ω=30°; and the bottom-most cutaway portion shows the unit antenna cell 125 with ω=60°. All unit antenna cells are folded simultaneously when the array 100 is folded; the cutaway portions in FIG. 1 are for exemplary purposes only. FIG. 3 shows a portion of a passive antenna array with a coordinate system set up for incident waves, defining an incident wave X-Z angle (θ) and an incident wave X-Y angle (ϕ).

Figure 6:
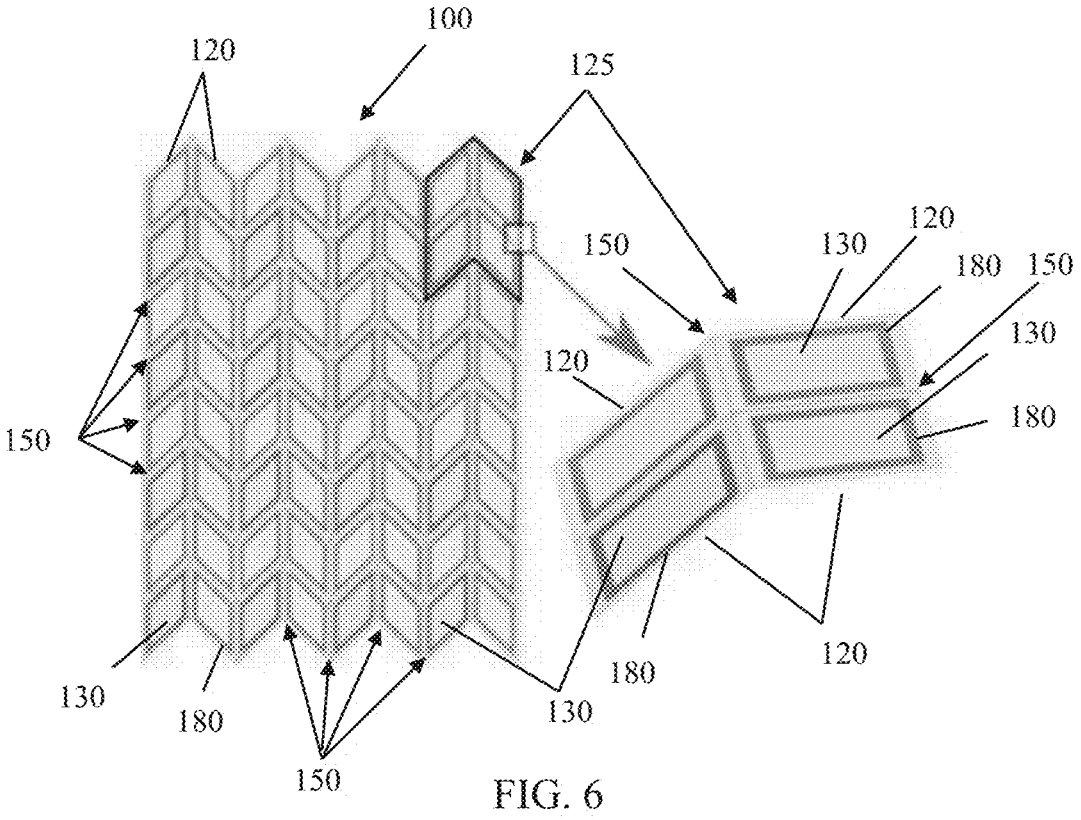
FIG. 6 is a schematic view showing a passive antenna array according to an embodiment of the subject invention, with a cutaway of a unit antenna cell of four antenna portions.
Figure 7:
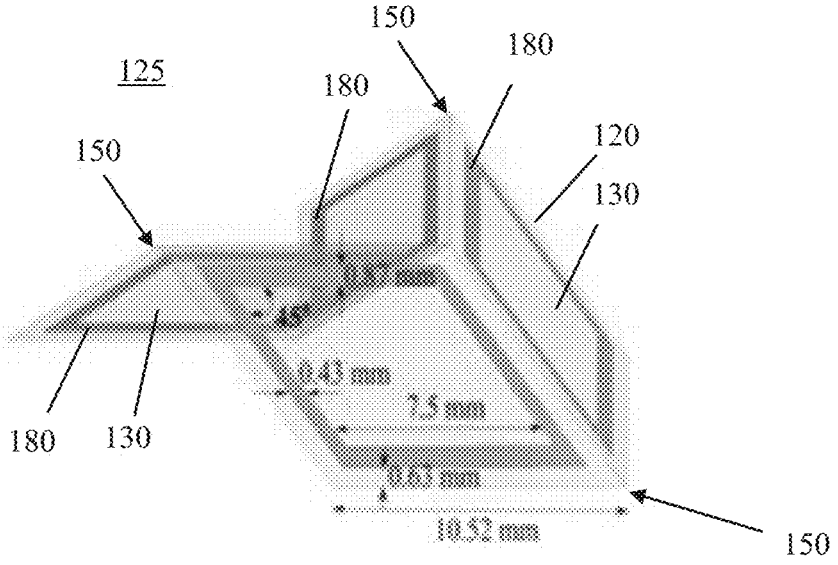
FIG. 7 is a schematic view showing a single unit antenna cell of four antenna portions, according to an embodiment of the subject invention. The unit antenna cell is in a folded state. The dimensions listed on FIG. 7 are strictly for exemplary purposes and should not be construed as limiting.

FIG. 6 is a schematic view showing a passive antenna array 100 according to an embodiment of the subject invention, with a cutaway of a unit antenna cell 125 of four antenna portions 120; and FIG. 7 is a schematic view showing the unit antenna cell 125 (from the cutaway of FIG. 6) in a folded state. The dimensions listed on FIG. 7 are strictly for exemplary purposes and should not be construed as limiting. Referring to FIGS. 6 and 7, the passive antenna array 100 can include a substrate 130 and a plurality of antenna elements 180 disposed on the substrate. The substrate can include folding lines 150 (e.g., folding lines for mountain- and/or valley-style folds) for folding the passive antenna array into different (predetermined) folding states. Similar to the embodiment shown in FIG. 1, the folding lines 150 can divide the substrate 130 into a plurality of antenna portions 120, and each antenna portion 120 can include an antenna element 180. Though FIG. 6 depicts antenna elements 180 in a rhombic shape, embodiments are not limited thereto. Each antenna element can have any suitable shape. The array 100 can include a plurality of unit antenna cells 125, each of which includes one or more antenna portions 120. The shape of a unit antenna cell 125 is determined by the predetermined folding states, which can be determined by the folding lines 150. For example, FIG. 6 shows a Miura origami fold pattern, and the unit antenna cell 125 includes four antenna portions 120 as shown in FIG. 7. The Miura origami fold shown in FIGS. 6 and 7 is for exemplary purposes only and should not be construed as limiting; any suitable fold pattern can be used.

The substrate can be a dielectric substrate, though embodiments are not necessarily limited thereto. The substrate can be any suitable material known in the art, such as paper, cardboard, plastic, FR4, Kapton, or Duroid. The substrate can have a thickness of any of the following values, at least any of the following values, about any of the following values, no more than any of the following values, or within any range having any of the following values as endpoints (all values are in millimeter (mm)): 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2, 2.5, 3, 3.5, 4, 4.5, 5, 5.5, 6, 6.5, 7, 7.5, 8, 8.5, 9, 9.5, 10, 11, 12, 13, 14, or 15. These values are exemplary only and should not be construed as limiting. The total thickness of the substrate and the antenna element can be any of the following values, at least any of the following values, about any of the following values, no more than any of the following values, or within any range having any of the following values as endpoints (all values are in mm): 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2, 2.5, 3, 3.5, 4, 4.5, 5, 5.5, 6, 6.5, 7, 7.5, 8, 8.5, 9, 9.5, 10, 11, 12, 13, 14, 15, 16, 17, 18, 19, 20, 21, 22, 23, 24, 25, 25.4, 26, 27, 28, 29, or 30. These values are exemplary only and should not be construed as limiting. Any thickness can be used as long as the substrate can fold without breaking (e.g., by folding itself or by folding using hinges).

The antenna element can be configured to operate at a desired frequency or multiple such frequencies. In many embodiments, the antenna element can be configured to operate at any frequency (e.g., a frequency in a range of from 1 gigahertz (GHz) to 12 GHz). For example, the antenna element can be configured to operate at a frequency of any of the following values, at least any of the following values, about any of the following values, no more than any of the following values, or within any range having any of the following values as endpoints (all values are in GHz): 1, 2, 3, 4, 5, 6, 7, 8, 9, 10, 11, 12, 13, 14, or 15. These values are exemplary only and should not be construed as limiting. For example, the antenna design can be scaled up or down to obtain any desired frequency.

The material for each antenna element 180 can be any suitable material known in the art. For example, each antenna element can be copper, aluminum, gold, silver, or platinum. In an embodiment, the antenna elements 180 can all be the same material, and in alternative embodiment, multiple different materials can be used for respective antenna elements 180.

In many embodiments, the origami pattern (e.g., a Miura-Ori pattern) is used to transform a single-band frequency selective surface (FSS) response to a dual-band FSS response. Specifically, by orienting neighboring antenna elements at appropriate relative angles (ψ), which may or may not match the orientation of the folding lines of the origami pattern, a single-band or a dual-band FSS response can be obtained (see, e.g., FIGS. 12A-14C).

Referring to FIGS. 1, 8A, 8B, and 9-15, the folding angle (ω) and the relative angle (ψ) affect the electromagnetic behavior of the origami passive arrays. As the folding angle (ω) changes, it tunes the frequency response (see, e.g., FIGS. 8A, 8B, and 15). As the relative angle (ψ) between neighboring antenna elements changes, it changes the single-band frequency selective surface response to a dual-band response (see, e.g., FIGS. 9-14C).

In an embodiment, a method fabricating a passive antenna array can comprise providing a substrate and forming (e.g., printing) a plurality of antenna elements thereon. The antenna elements can be formed on the substrate using any suitable technique(s) known in the art. The substrate with antenna elements can then be folded to create the folding lines. In an alternative embodiment, the folding lines can be created before forming the antenna elements or the substrate can already have folding lines before the method begins. Once the antenna elements and the folding lines are present, the passive antenna array has been fabricated, and it can be folded into different states to reconfigure its electromagnetic (EM) characteristics as desired. The substrate can include hinges for folding instead of folding lines.

Passive antenna arrays of embodiments of the subject invention are deployable, packable, and foldable. The passive antenna arrays can adjust their EM characteristics based on a user's requests/desires and/or based on environmental requirements (e.g., from an EM point of view). The ability to change shape (into different states (unfolded or multiple folded states)) allow the antenna array to operate at different frequencies. The passive antenna arrays can be categorized as FSSs.

Passive antenna arrays of embodiments of the subject invention exhibit dual band operation (e.g., can operate as a dual band filter) instead of the single band operation exhibited in related art passive arrays. Passive antenna arrays of embodiments of the subject invention can change the frequency band(s) of operation by changing the shape of the array. The passive antenna arrays can be insensitive (or nearly insensitive) to variations in the angle of incident waves (θ and/or ϕ). Also, the passive antenna arrays can show wideband operation.

Passive antenna arrays of embodiments of the subject invention can be particularly useful for multi-functional communications, satellite communication systems, radar systems, radar cross section reduction, and deployable and collapsible arrays.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to the invention.

Example 1

Figure 2:
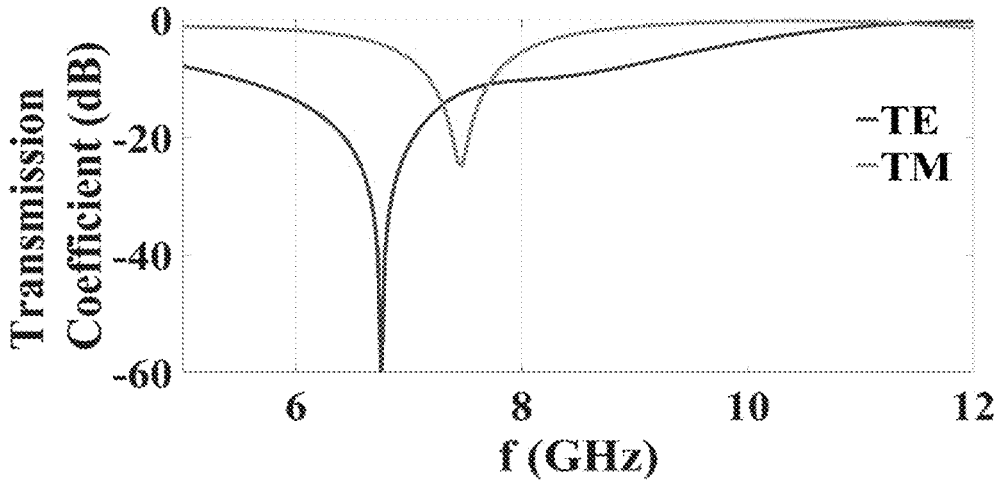
FIG. 2 is a plot showing transmission coefficient (in decibels (dB)) versus frequency (in gigahertz (GHz)) for a passive antenna array in transverse electric (TE) mode and transverse magnetic (TM) mode. The uppermost (green) line at a 6 GHz is for TM mode; and the lowermost (blue) line at 6 GHz is for TE mode.
Figure 4A:
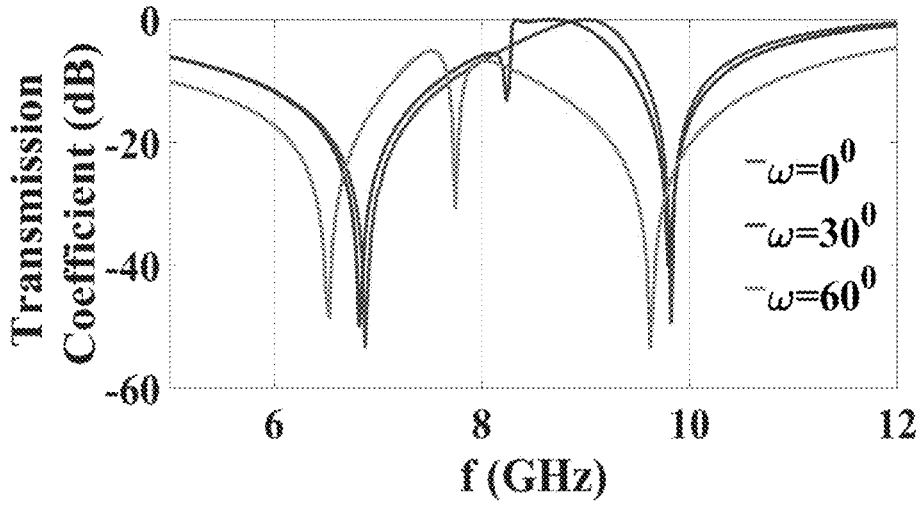
FIG. 4A is a plot showing transmission coefficient (in dB) versus frequency (in GHz) for a passive antenna array at different folding angles (ω). The left-most (green) line at −40 dB is for ω=60°; the second-from-the-left (blue) line at −40 dB is for ω=30°; and the third-from-the-left (red) line at −40 dB is for ω=0°.
Figure 4B:
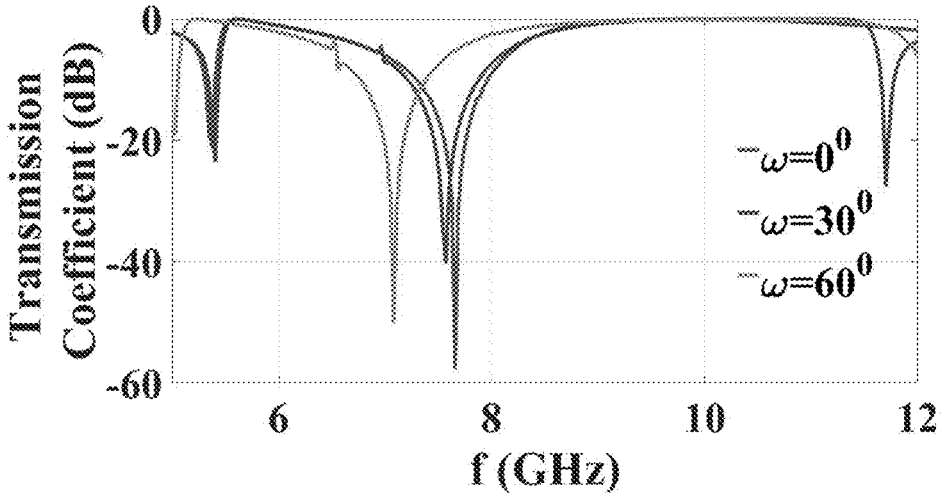
FIG. 4B is a plot showing transmission coefficient (in dB) versus frequency (in GHz) for a passive antenna array at different folding angles (ω). The left-most (green) line at −40 dB is for ω=60°; the middle (blue) line at −40 dB is for ω=30°; and the right-most (red) line at −40 dB is for w=0°.

A passive antenna array as shown in FIG. 1, with tilted-Jerusalem-cross-shaped antenna elements and a Miura-Ori folding pattern to the substrate, was tested. FIG. 2 shows a plot of the transmission coefficient (in decibels (dB)) versus frequency (in gigahertz (GHz)) for the passive antenna array in transverse electric (TE) mode and transverse magnetic (TM). FIG. 4A shows the transmission coefficient at different folding angles (ω) in TE mode, and FIG. 4B shows the transmission coefficient at different folding angles in TM mode.

Figure 5A:
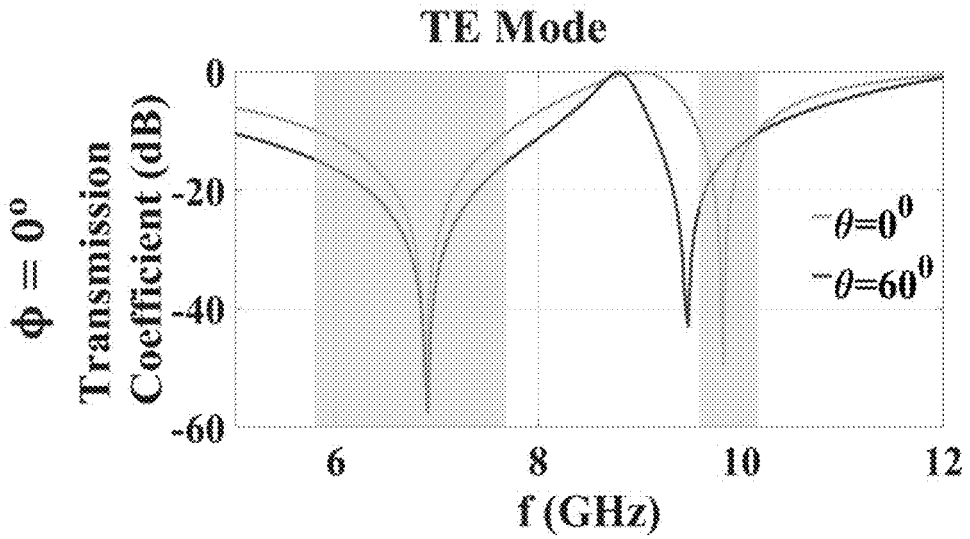
FIG. 5A is a plot showing transmission coefficient (in dB) versus frequency (in GHz) for a passive antenna array in TE mode at different incident wave X-Z angles (θ; see also FIG. 3), for a constant incident wave X-Y angle (ϕ; see also FIG. 3) of 0°. The uppermost (orange) line at 6 GHz is for θ=0°; and the lower-most (blue) line at 6 GHz is for θ=60°.
Figure 5B:
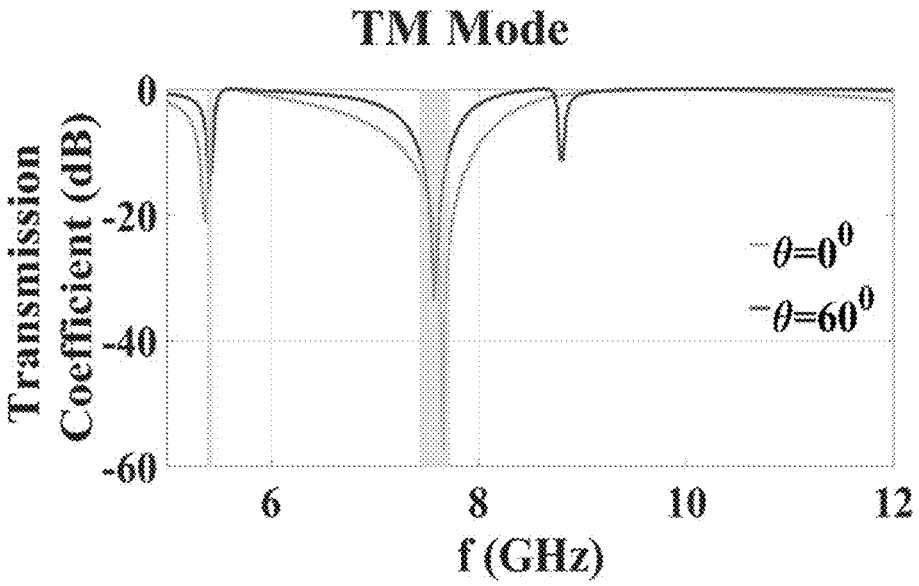
FIG. 5B is a plot showing transmission coefficient (in dB) versus frequency (in GHz) for a passive antenna array in TM mode at different incident wave X-Z angles (θ; see also FIG. 3), for a constant incident wave X-Y angle (ϕ; see also FIG. 3) of 0°. The uppermost (blue) line at 8 GHz is for θ=60°; and the lower-most (orange) line at 8 GHz is for θ=0°.
Figure 5C:
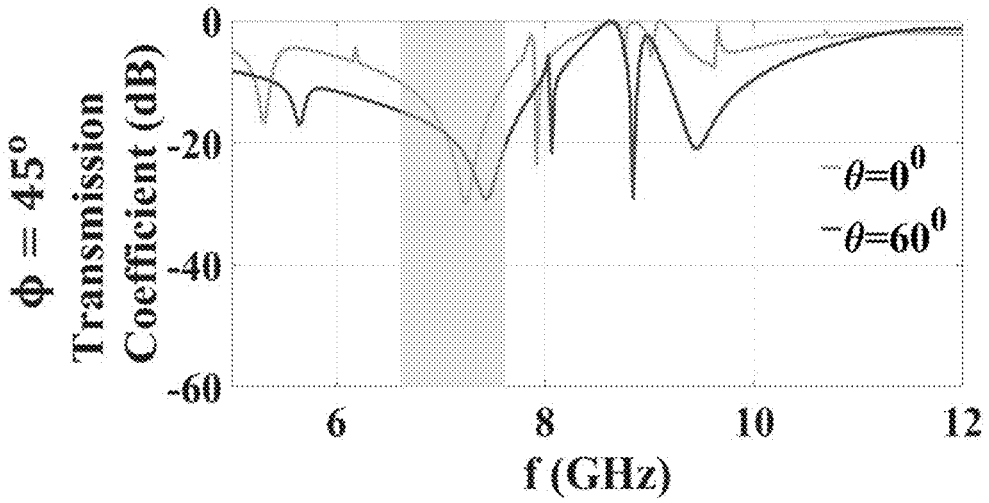
FIG. 5C is a plot showing transmission coefficient (in dB) versus frequency (in GHz) for a passive antenna array in TE mode at different incident wave X-Z angles (θ; see also FIG. 3), for a constant incident wave X-Y angle (ϕ; see also FIG. 3) of 45°. The uppermost (orange) line at 6 GHz is for θ=0°; and the lower-most (blue) line at 6 GHz is for θ=60°.
Figure 5D:
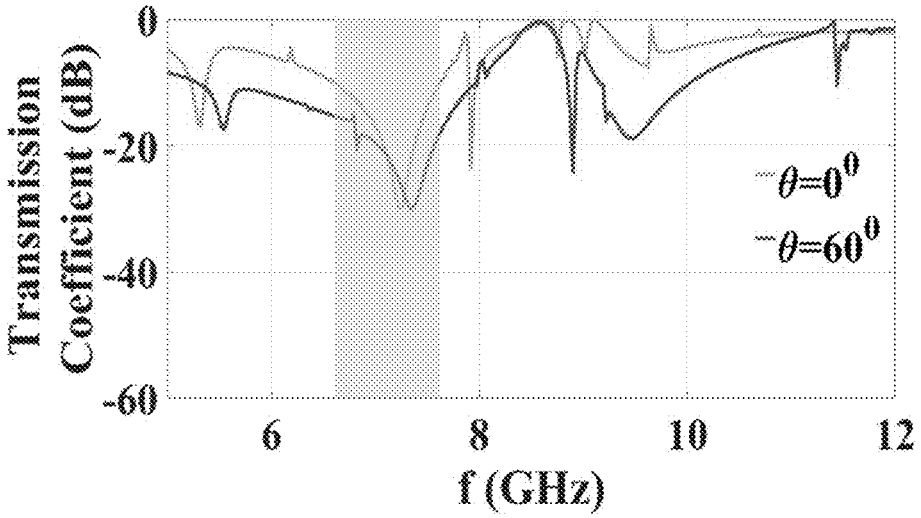
FIG. 5D is a plot showing transmission coefficient (in dB) versus frequency (in GHz) for a passive antenna array in TM mode at different incident wave X-Z angles (θ; see also FIG. 3), for a constant incident wave X-Y angle (ϕ; see also FIG. 3) of 45°. The uppermost (orange) line at 6 GHz is for θ=0°; and the lower-most (blue) line at 6 GHz is for θ=60°.

Next, the incident wave X-Z angle (θ) and an incident wave X-Y angle (ϕ) were altered while measuring the transmission coefficient. FIG. 5A shows a plot of the transmission coefficient (in dB) versus frequency (in GHz) for the passive antenna array in TE mode at different incident wave X-Z angles (θ; see also FIG. 3), for a constant incident wave X-Y angle (ϕ; see also FIG. 3) of 0°; FIG. 5B shows the transmission coefficient in TM mode at varying θ for a constant ϕ=0°; FIG. 5C shows the transmission coefficient in TE mode at varying θ for a constant ϕ=45°; and FIG. 5D shows the transmission coefficient in TM mode at varying θ for a constant ϕ=45°.

Referring to FIGS. 2 and 4A-5D, the passive antenna array exhibits dual band operation, can change the frequency band(s) of operation by changing the shape (e.g., fold angle) of the array, and is insensitive to variations in the angle of incident waves (θ and/or ϕ).

Example 2

Figure 8A:
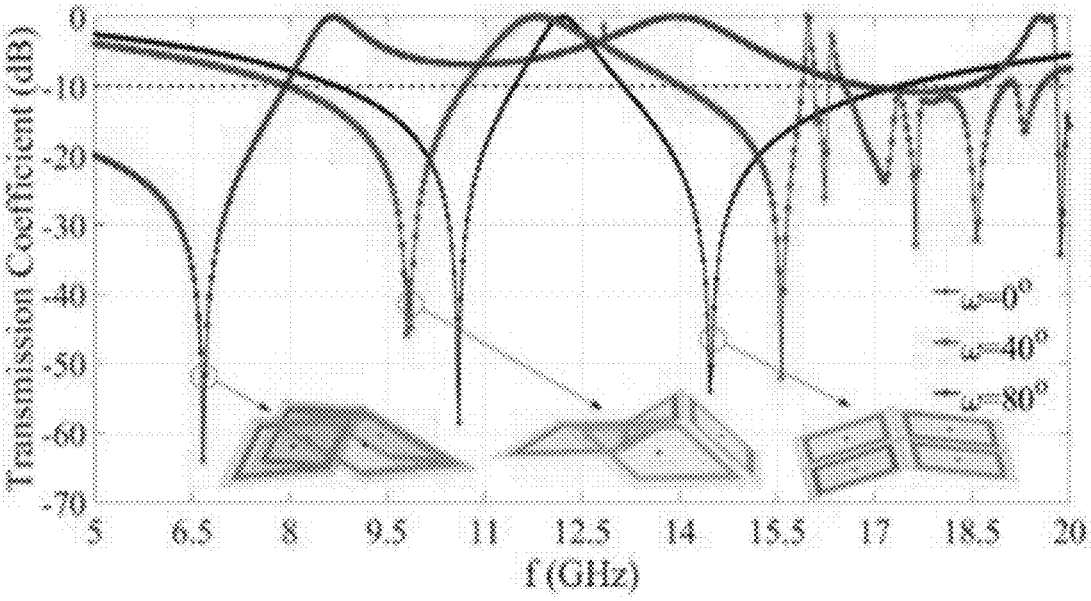
FIG. 8A is a plot showing transmission coefficient (in dB) versus frequency (in GHz) for a passive antenna array with TE polarization at different folding angles (ω). The left-most (blue) line at −30 dB is for ω=80°; the second-from-the-left (red) line at −30 dB is for ω=40°; and the third-from-the-left (black) line at −30 dB is for ω=0°.

A passive antenna array as shown in FIG. 6, with rhombic antenna elements and a Miura-Ori folding pattern to the substrate, was tested. FIG. 8A shows a plot of transmission coefficient (in dB) versus frequency (in GHz) for the passive antenna array with TE polarization at different folding angles (ω); and FIG. 8B shows the transmission coefficient with TM polarization at different folding angles.

Figure 8B:
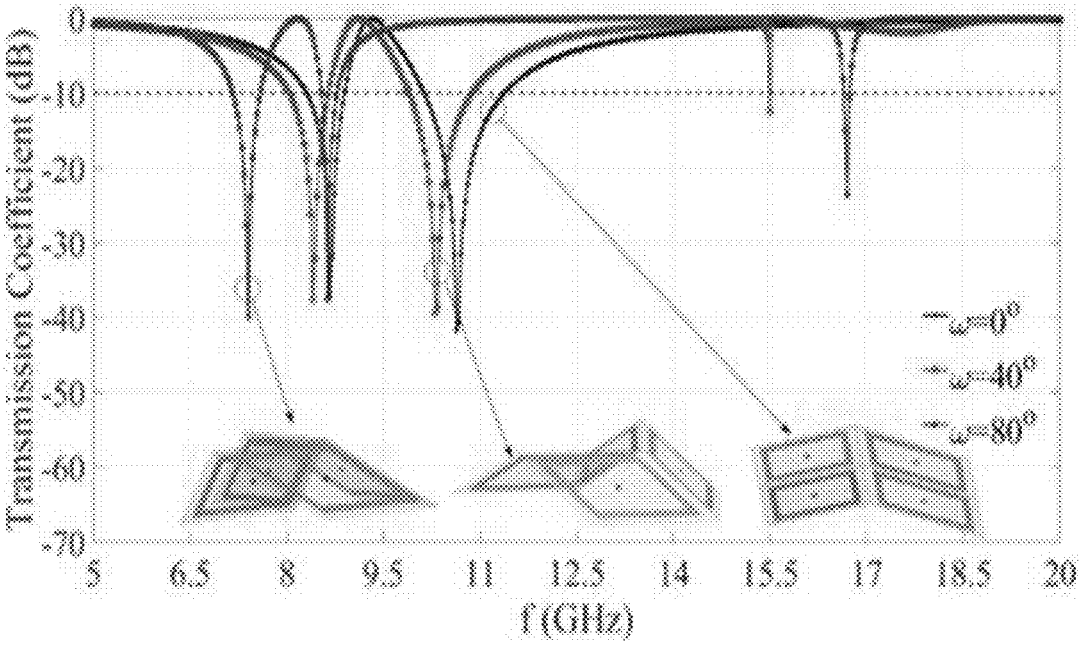
FIG. 8B is a plot showing transmission coefficient (in dB) versus frequency (in GHz) for a passive antenna array with TM polarization at different folding angles (ω). The left-most (blue) line at −30 dB is for ω=80°; the second-from-the-left (red) line at −30 dB is for ω=40°; and the far-right (black) line at −40 dB is for ω=0°.
Figure 9:
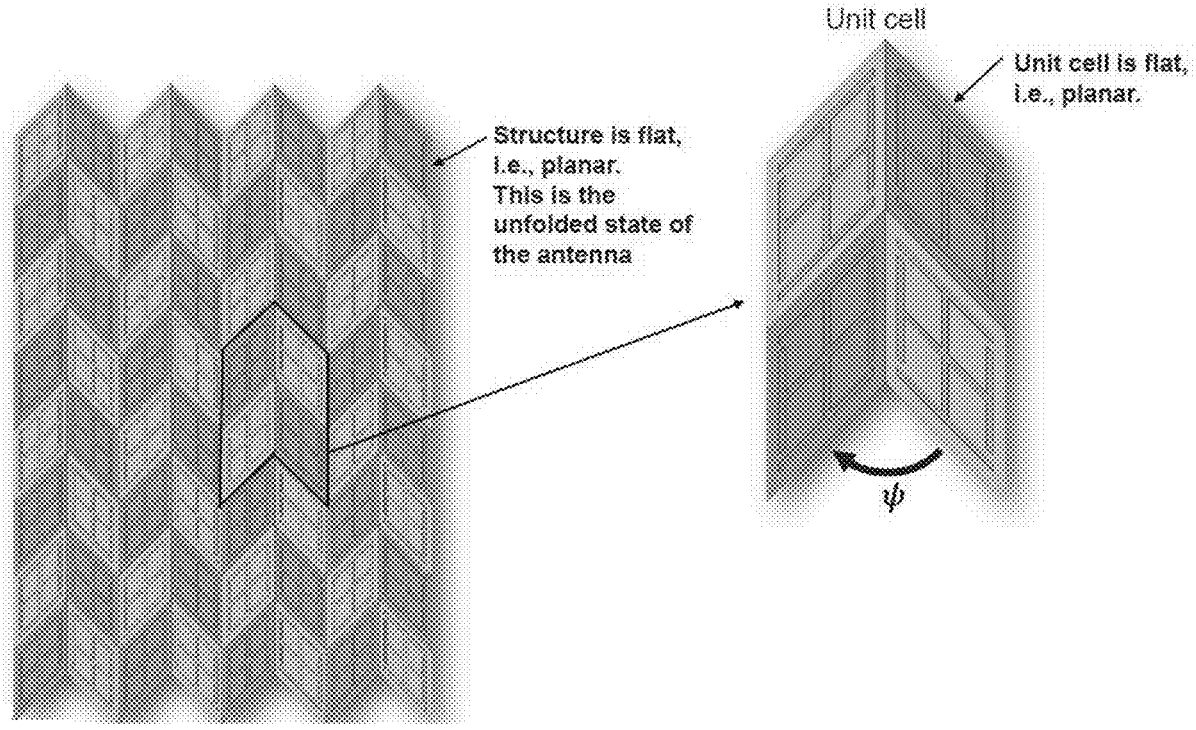
FIG. 9 is a schematic view showing a passive antenna array according to an embodiment of the subject invention. The cutaway shows a unit antenna cell of four antenna portions in a flat state (folding angle, ω, =0°). The relative angle (ψ) is shown and is a measure of the angle between the antenna portions, which have Jerusalem cross antenna elements. The relative angle introduces dual band frequency response.
Figure 10:
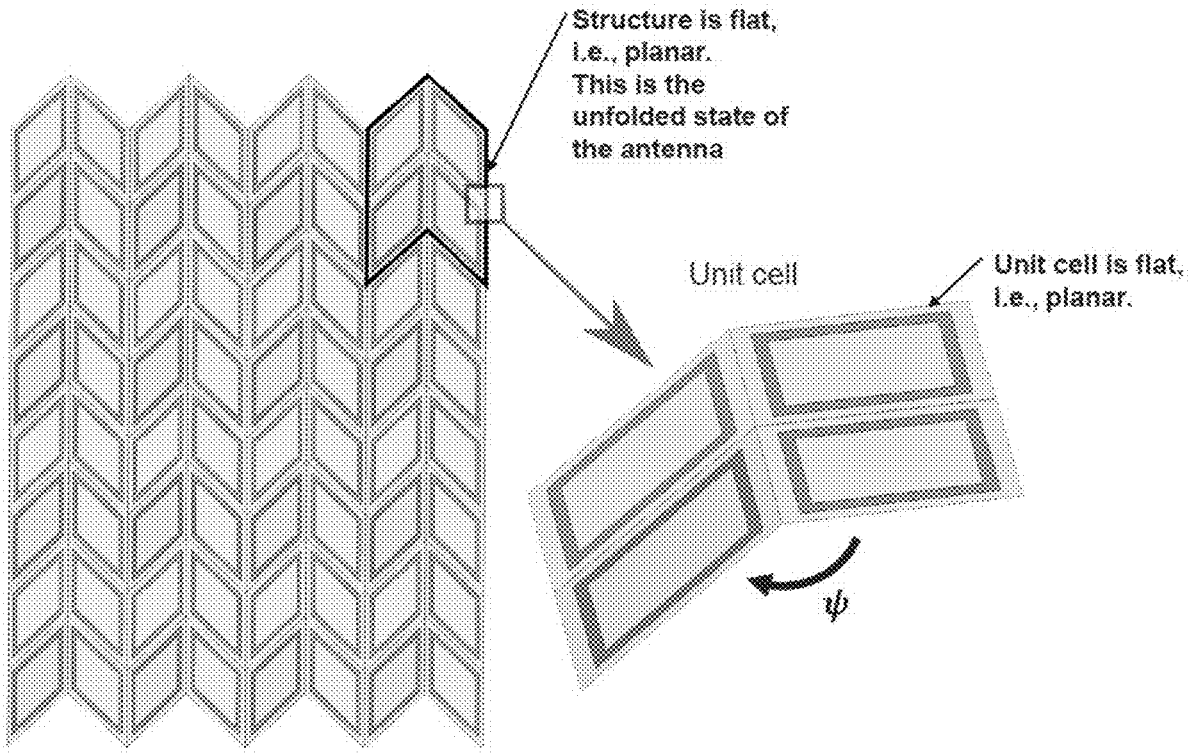
FIG. 10 is a schematic view showing a passive antenna array according to an embodiment of the subject invention. The cutaway shows a unit antenna cell of four antenna portions in a flat state (folding angle, ω, =0°). The relative angle (ψ) is shown, and the antenna portions have rhombic antenna elements.
Figure 11A:
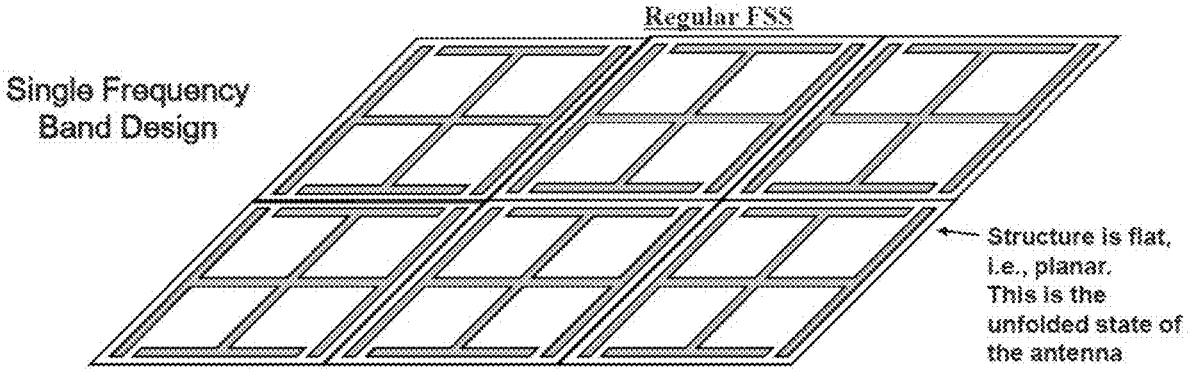
FIG. 11A is a schematic view showing a single frequency band design frequency selective surface (FSS) in a flat state. The antenna portions have Jerusalem cross antenna elements.
Figure 11B:
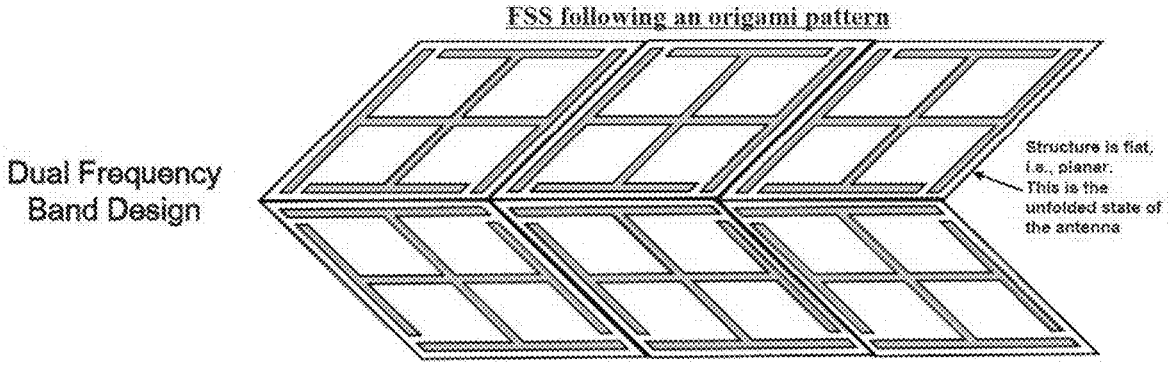
FIG. 11B is a schematic view showing a dual frequency band design FSS in a flat state according to an embodiment of the subject invention. The antenna portions have Jerusalem cross antenna elements.
Figure 11C:
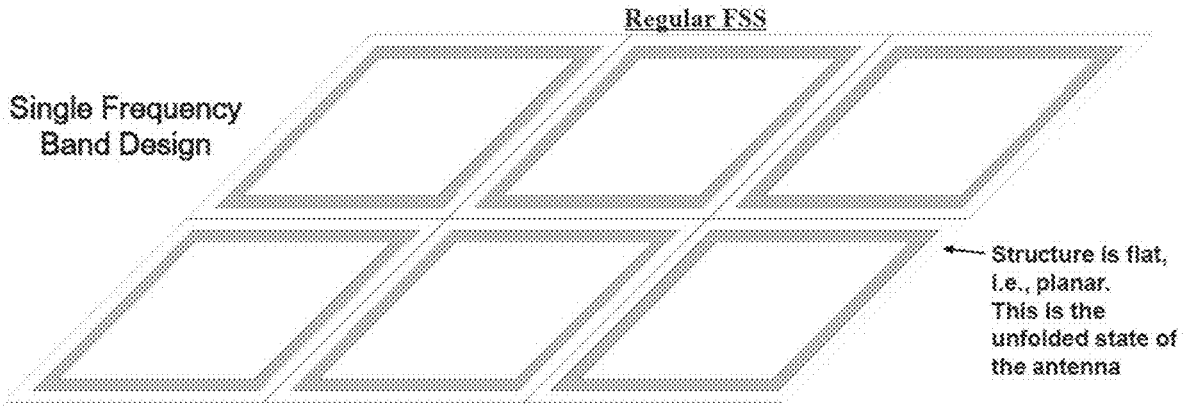
FIG. 11C is a schematic view showing a single frequency band design FSS in a flat state. The antenna portions have rhombic antenna elements.
Figure 11D:
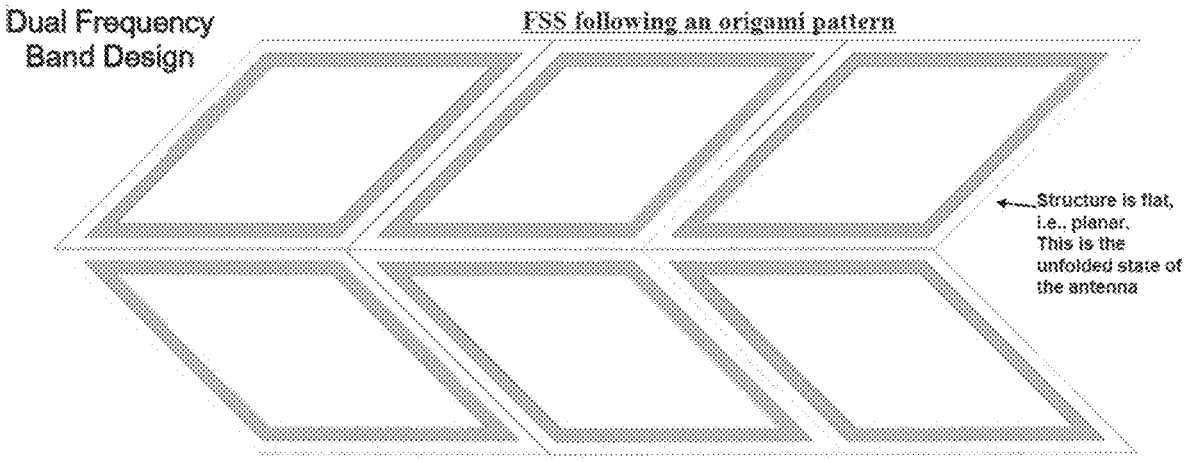
FIG. 11D is a schematic view showing a dual frequency band design FSS in a flat state according to an embodiment of the subject invention. The antenna portions have rhombic antenna elements.
Figure 12A:
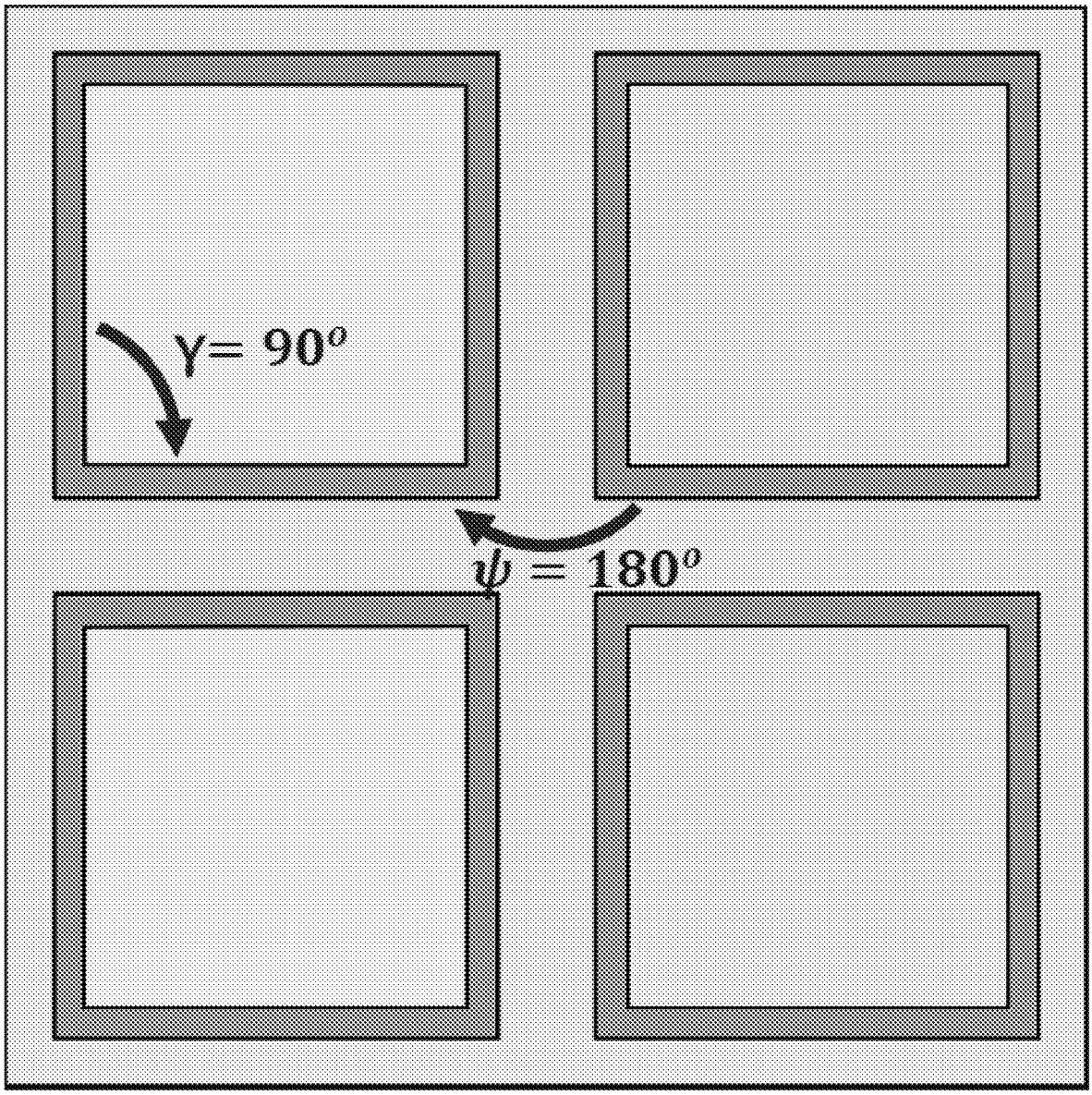
FIG. 12A shows a unit antenna cell of four antenna portions for single frequency band response. The relative angle is 180°, and the antenna element angle (γ) is shown. When the antenna element is half of the relative angle (i.e., when γ=ψ/2), this guarantees that the orientation of the elements follows the orientation of the Miura-Ori pattern.
Figure 12B:
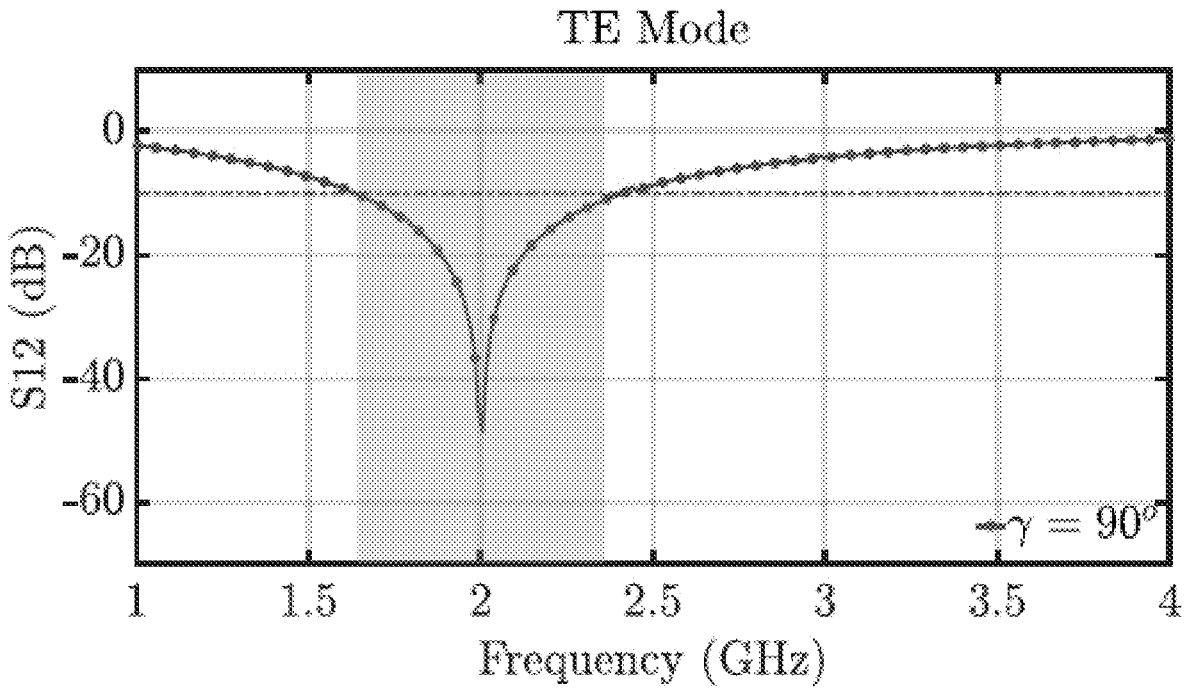
FIG. 12B is a plot showing $S_{12}$ (in dB) versus frequency (in GHz) for the unit cell of FIG. 12A (the line that is not simply straight in the plot) in TE mode.
Figure 12C:
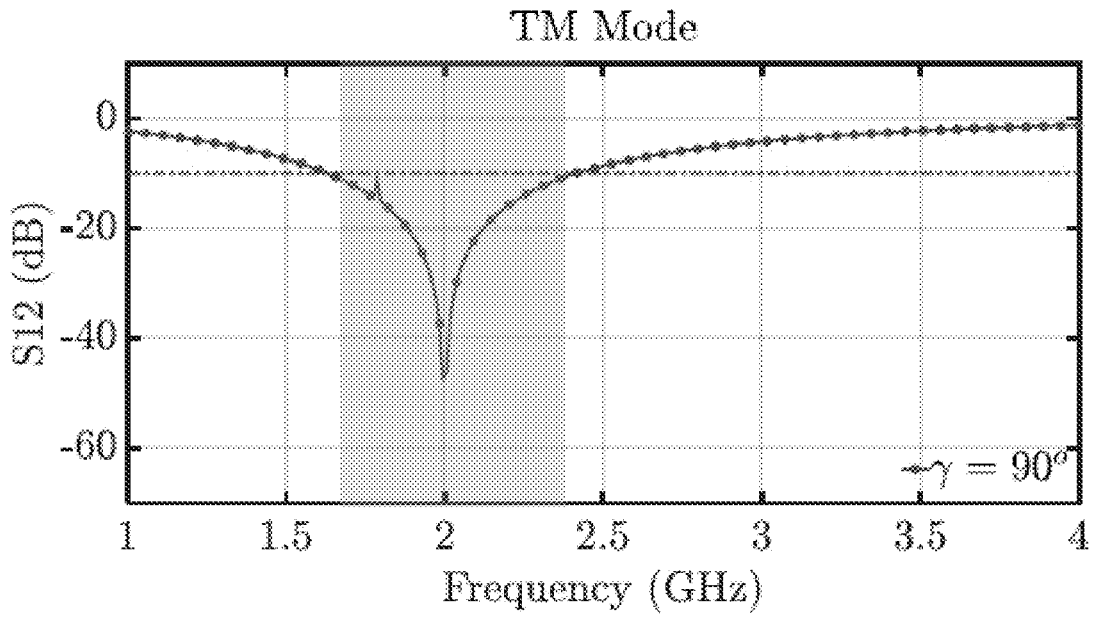
FIG. 12C is a plot showing $S_{12}$ (in dB) versus frequency (in GHz) for the unit cell of FIG. 12A (the line that is not simply straight in the plot) in TM mode.
Figure 13A:
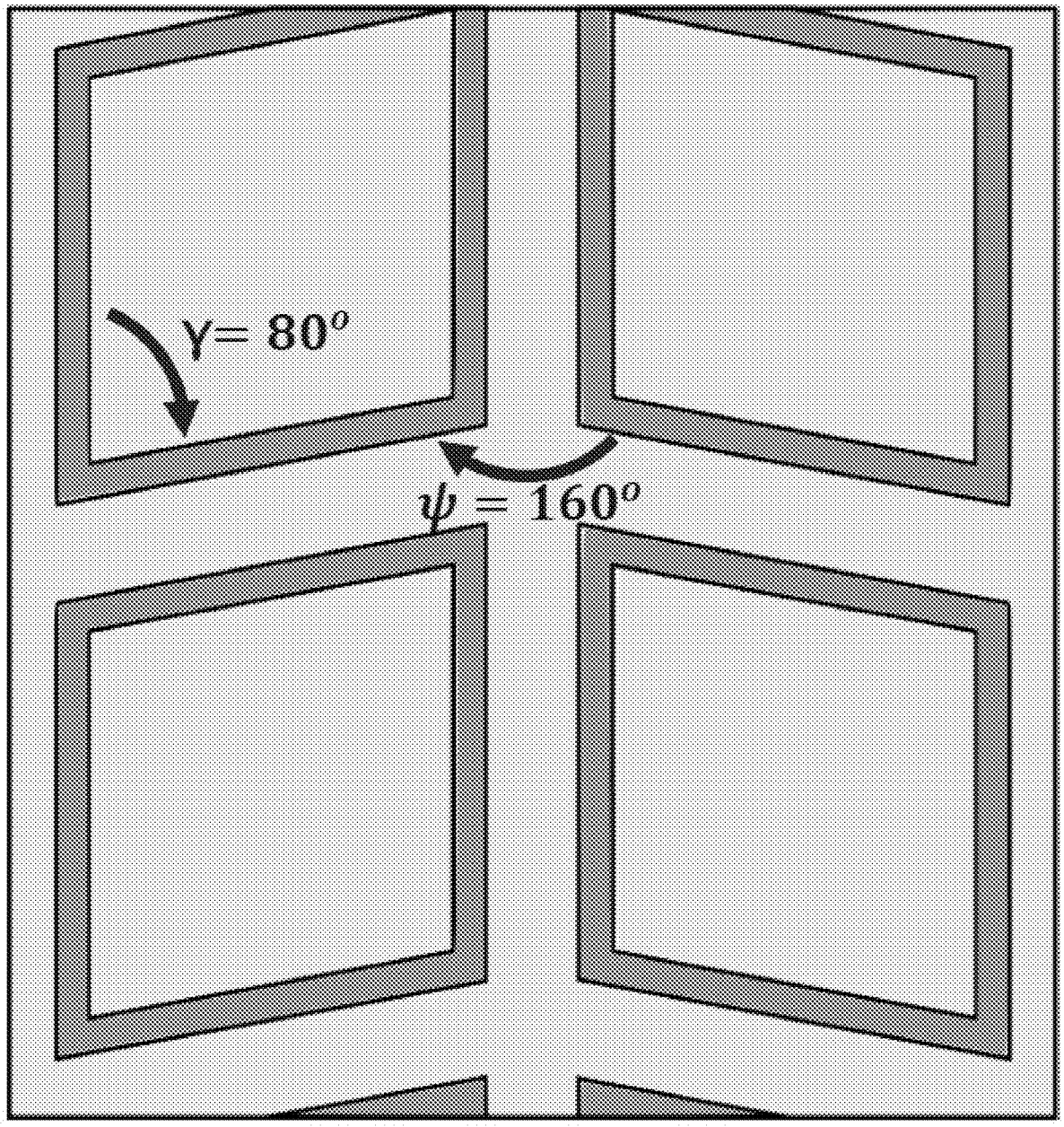
FIG. 13A shows a unit antenna cell of four antenna portions for dual frequency band response. The relative angle is 160°, and the antenna element angle (γ) is shown. When γ=ψ/2, this guarantees that the orientation of the elements follows the orientation of the Miura-Ori pattern.
Figure 13B:
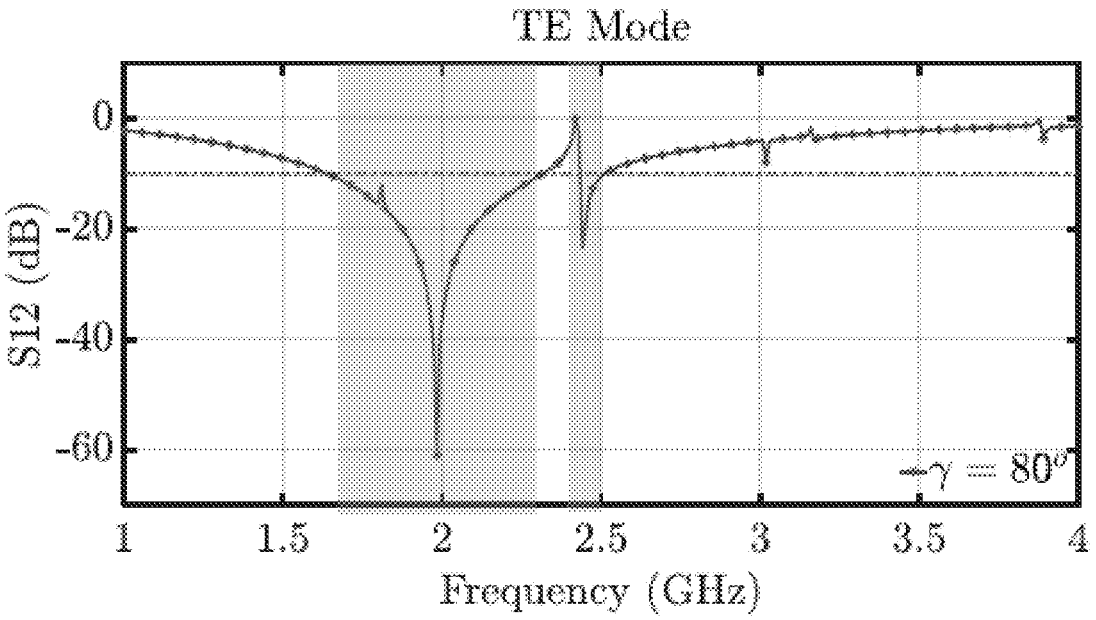
FIG. 13B is a plot showing $S_{12}$ (in dB) versus frequency (in GHz) for the unit cell of FIG. 13A (the line that is not simply straight in the plot) in TE mode.
Figure 13C:
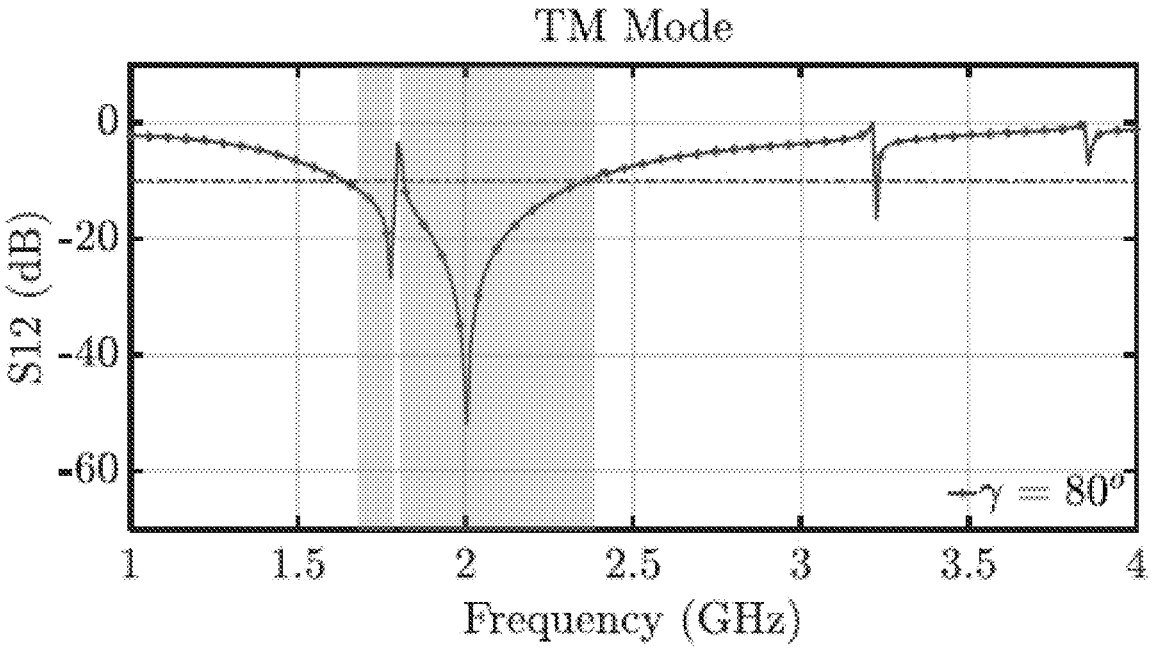
FIG. 13C is a plot showing $S_{12}$ (in dB) versus frequency (in GHz) for the unit cell of FIG. 13A (the line that is not simply straight in the plot) in TM mode.
Figure 14A:
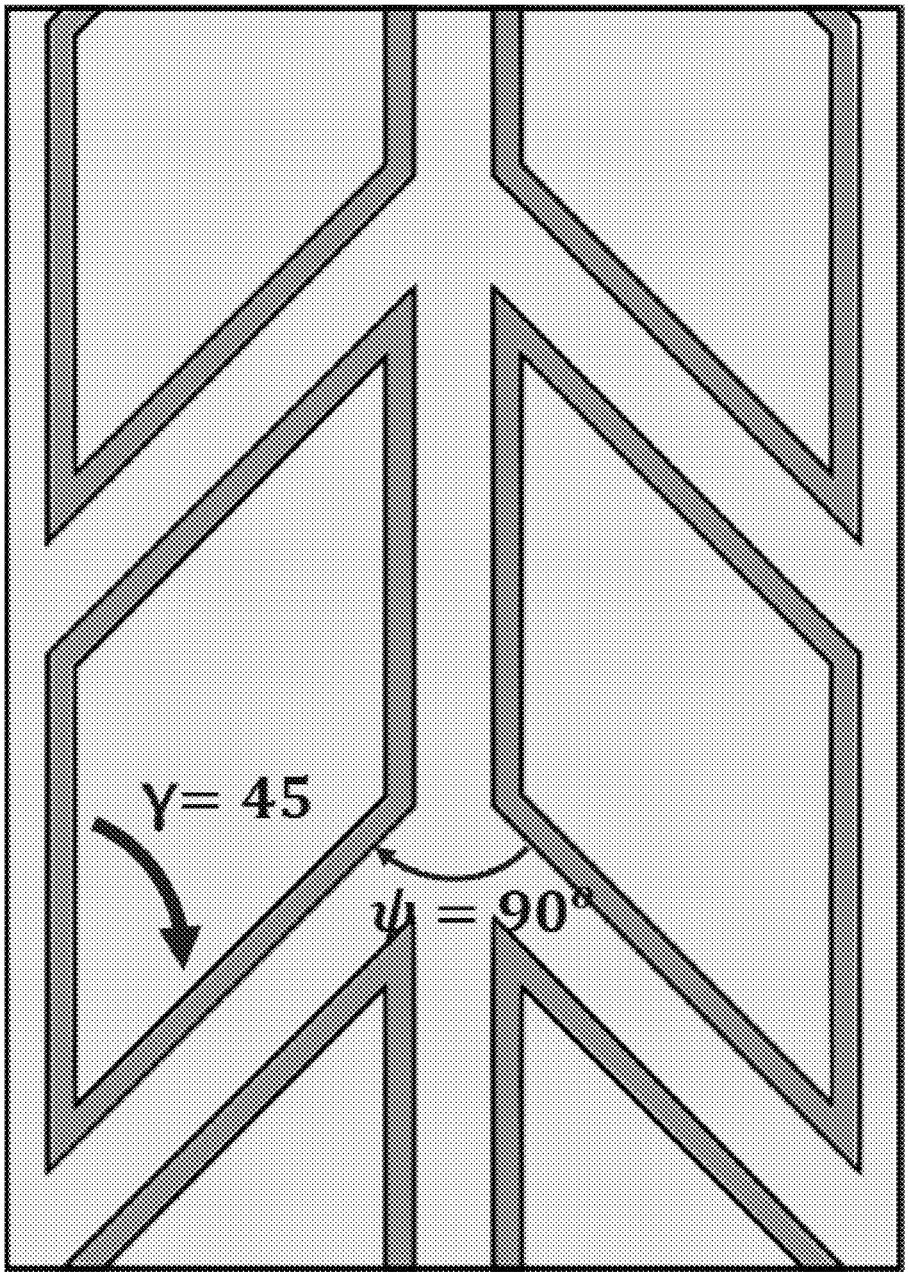
FIG. 14A shows a unit antenna cell of four antenna portions for dual frequency band response. The relative angle is 90°, and the antenna element angle (γ) is shown. When γ=ψ/2, this guarantees that the orientation of the elements follows the orientation of the Miura-Ori pattern.
Figure 14B:
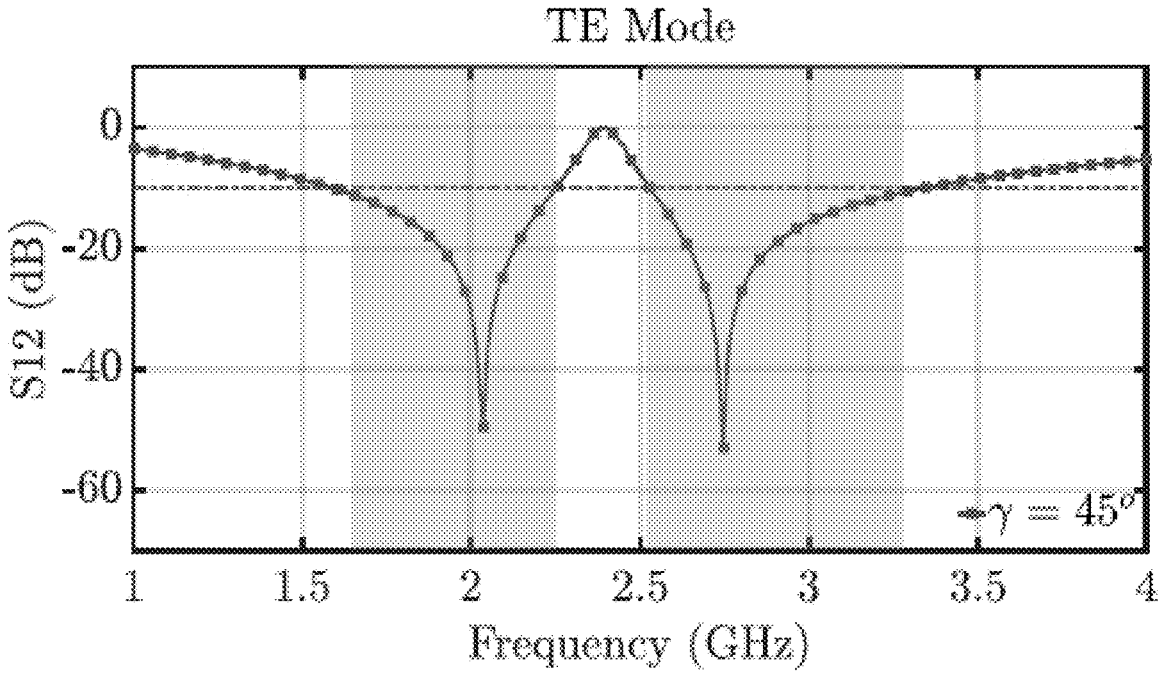
FIG. 14B is a plot showing $S_{12}$ (in dB) versus frequency (in GHz) for the unit cell of FIG. 14A (the line that is not simply straight in the plot) in TE mode.
Figure 14C:
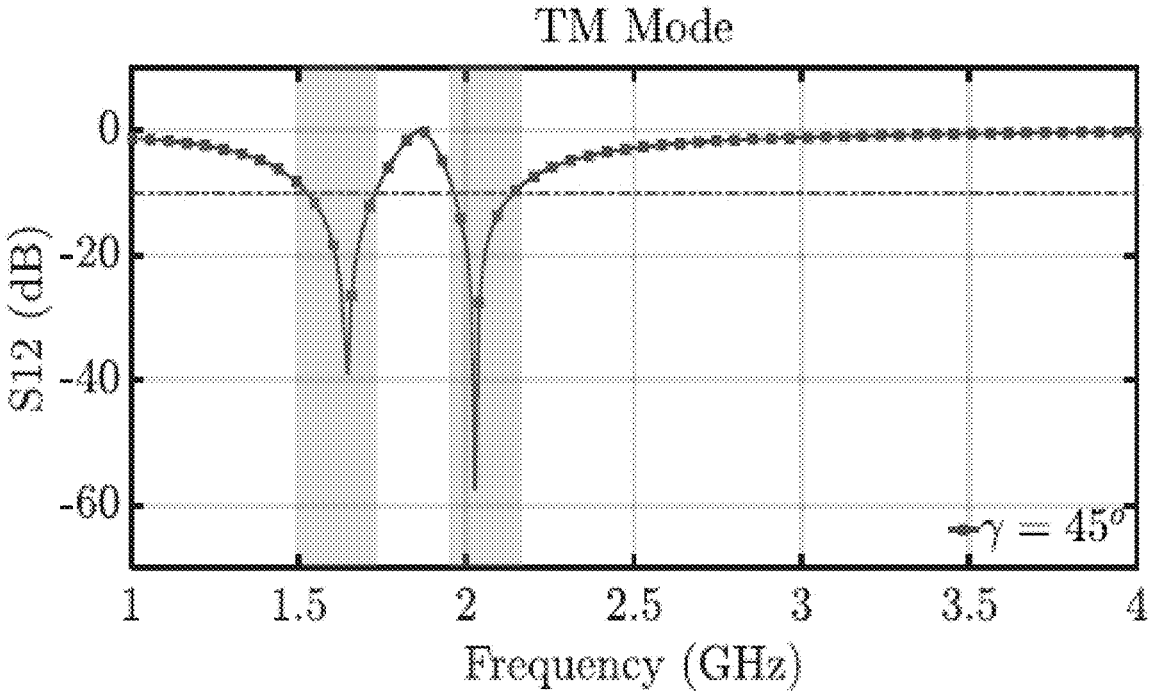
FIG. 14C is a plot showing $S_{ii}$ (in dB) versus frequency (in GHz) for the unit cell of FIG. 14A (the line that is not simply straight in the plot) in TM mode.
Figure 15:
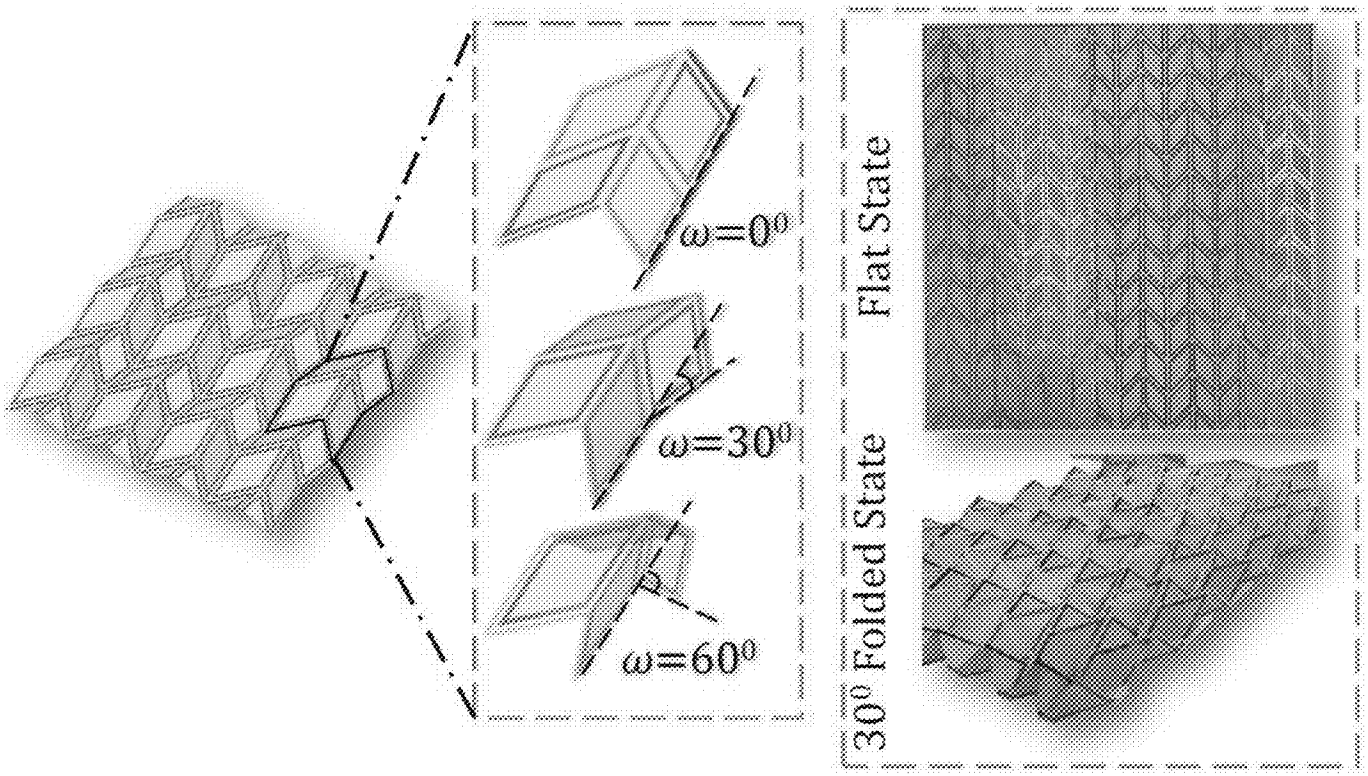
FIG. 15 is a schematic view showing a passive antenna array (far left) according to an embodiment of the subject invention. The middle portion cutaway shows a unit antenna cell of four antenna portions in a flat state (folding angle, ω, =0°), a first folded state (ω=30°), and a second folded state (ω=60°). The far right portion shows images of a fabricated passive antenna array on a polyimide substrate in a flat state (top) and a first folded state (bottom, ω=) 30°.

Referring to FIGS. 8A-8B, the passive antenna array exhibits dual band operation and can change the frequency band(s) of operation by changing the shape (e.g., fold angle).

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A passive antenna array, comprising:

a foldable substrate configured to be folded; and a plurality of antenna elements disposed on the substrate, the foldable substrate having predefined folding lines that fold into a Miura-Ori configuration, the passive antenna array having an unfolded state and a plurality of folded states including the Miura-Ori configuration, the predefined folding lines dividing the substrate into a plurality of discrete antenna portions, each antenna portion of the plurality of discrete antenna portions having a quadrilateral shape, and each of the quadrilateral-shaped antenna portions being unfolded when the passive antenna array is in the Miura-Ori configuration folded state, and the plurality of antenna elements being disposed on the plurality of discrete antenna portions, respectively, and each antenna portion comprising exactly one antenna element disposed thereon.

2. The passive antenna array according to claim 1, each antenna element of the plurality of antenna elements comprising a polygon shape.

3. The passive antenna array according to claim 1, each antenna element of the plurality of antenna elements comprising a rhombic shape.

4. The passive antenna array according to claim 1, each antenna element of the plurality of antenna elements comprising a tilted Jerusalem cross shape.

5. The passive antenna array according to claim 1, the foldable substrate being an origami substrate having the predefined folding lines.

6. The passive antenna array according to claim 1, the foldable substrate having a thickness of less than 30 millimeters (mm).

7. The passive antenna array according to claim 1, the foldable substrate comprising paper, cardboard, plastic, FR4, Kapton, or Duroid.

8. The passive antenna array according to claim 1, the passive antenna array being configured to operate at a frequency in a range of from 1 gigahertz (GHz) to 12 GHz.

9. The passive antenna array according to claim 1, each antenna element of the plurality of antenna elements comprising copper, aluminum, gold, silver, or platinum.

10. The passive antenna array according to claim 1, the passive antenna array being configured to operate at different respective frequency modes at the unfolded state and different folded states of the plurality of folded states.

11. The passive antenna array according to claim 1, the passive antenna array being configured such that a frequency response is tuned by changing a folding angle of antenna portions of the plurality of discrete antenna portions, and the passive antenna array being further configured such that a relative angle between neighboring antenna elements of the plurality of antenna elements determines whether the passive antenna array has single-band frequency selective surface response or dual-band frequency selective surface response.

12. The passive antenna array according to claim 1, the foldable substrate being a dielectric substrate.

13. A method of fabricating a passive antenna array, the method comprising:

providing a foldable substrate configured to be folded, the foldable substrate being an origami substrate;

forming a plurality of antenna elements on the foldable substrate; and folding the foldable substrate to create folding lines that fold into a Miura-Ori configuration, the passive antenna array having an unfolded state and a plurality of folded states including the Miura-Ori configuration, the folding lines dividing the substrate into a plurality of discrete antenna portions, each antenna portion of the plurality of discrete antenna portions having a quadrilateral shape, and each of the quadrilateral-shaped antenna portions being unfolded when the passive antenna array is in the Miura-Ori configuration folded state, and the plurality of antenna elements being disposed on the plurality of discrete antenna portions, respectively, and each antenna portion comprising exactly one antenna element disposed thereon.

14. The method according to claim 13, each antenna element of the plurality of antenna elements comprising a polygon shape or a tilted Jerusalem cross shape.

15. The method according to claim 13, each antenna element of the plurality of antenna elements comprising a polygon shape or a tilted Jerusalem cross shape, the passive antenna array having a thickness of less than 30 millimeters (mm), the passive antenna array being configured to operate at different respective frequency modes at the unfolded state and different folded states of the plurality of folded states, the foldable substrate comprising paper, cardboard, plastic, FR4, Kapton, or Duroid, each antenna element of the plurality of antenna elements comprising copper, aluminum, gold, silver, or platinum, and the forming of the plurality of antenna elements comprising printing the plurality of antenna elements on the foldable substrate.

16. A passive antenna array, comprising:

a foldable substrate configured to be folded; and a plurality of antenna elements disposed on the substrate, the foldable substrate having predefined folding lines that fold into a Miura-Ori configuration, the passive antenna array having an unfolded state and a plurality of folded states including the Miura-Ori configuration, the predefined folding lines dividing the substrate into a plurality of discrete antenna portions, each antenna portion of the plurality of discrete antenna portions having a quadrilateral shape, and each of the quadrilateral-shaped antenna portions being unfolded when the passive antenna array is in the Miura-Ori configuration folded state, the plurality of antenna elements being disposed on the plurality of discrete antenna portions, respectively, and each antenna portion comprising exactly one antenna element disposed thereon, each antenna element of the plurality of antenna elements comprising a rhombic shape or a tilted Jerusalem cross shape, the foldable substrate being an origami substrate the foldable substrate having a thickness of less than 30 millimeters (mm), the foldable substrate comprising paper, cardboard, plastic, FR4, Kapton, or Duroid, the passive antenna array being configured to operate at a frequency in a range of from 1 gigahertz (GHz) to 12 GHz, each antenna element of the plurality of antenna elements comprising copper, aluminum, gold, silver, or platinum, the passive antenna array being configured to operate at different respective frequency modes at the unfolded state and different folded states of the plurality of folded states, the passive antenna array being configured such that a frequency response is tuned by changing a folding angle of antenna portions of the plurality of antenna portions, the passive antenna array being further configured such that a relative angle between neighboring antenna elements of the plurality of antenna elements determines whether the passive antenna array has single-band frequency selective surface response or dual-band frequency selective surface response, and the foldable substrate being a dielectric substrate.

* * * * *